US006053954A

United States Patent [19]

Anderson et al.

[11] Patent Number: 6,053,954

[45] Date of Patent: Apr. 25, 2000

[54] METHODS TO ENHANCE THE CHARACTERISTICS OF HYDROTHERMALLY PREPARED SLURRY FUELS

[75] Inventors: Chris M. Anderson, Shakopee, Minn.; Mark A. Musich, Grand Forks, N. Dak.; Michael D. Mann, Thompson, N. Dak.; Raymond A. DeWall; John J. Richter, both of Grand Forks, N. Dak.; Todd A. Potas, Plymouth, Minn.; Warrack G. Willson, Fairbanks, Ak.

[73] Assignee: Energy & Environmental Research Center, Grand Forks, N. Dak.

[21] Appl. No.: 08/874,963

[22] Filed: Jun. 13, 1997

Related U.S. Application Data

[60] Provisional application No. 60/019,780, Jun. 14, 1996.

[51] Int. Cl.[7] ..... C10L 1/00

[52] U.S. Cl. ..... 44/280

[58] Field of Search ..... 44/280

[56] References Cited

U.S. PATENT DOCUMENTS

| | | | |
|---|---|---|---|
| 1,471,949 | 10/1923 | Doranski | 152/9 |
| 1,632,829 | 6/1927 | Fleissner | 44/620 |
| 1,679,078 | 7/1928 | Fleissner | 44/620 |
| 3,552,031 | 1/1971 | Evans et al. | 34/9 |
| 3,992,784 | 11/1976 | Verschur | 34/12 |
| 4,018,571 | 4/1977 | Cole et al. | 241/17 |
| 4,052,168 | 10/1977 | Koppelman | 201/17 |
| 4,052,169 | 10/1977 | Cole et al. | 44/620 |
| 4,465,495 | 8/1984 | Scheffee | 44/280 |
| 4,898,107 | 2/1990 | Dickinson et al. | 110/346 |
| 4,933,086 | 6/1990 | McMahon et al. | 210/603 |
| 4,983,296 | 1/1991 | McMahon et al. | 210/603 |
| 5,188,740 | 2/1993 | Khan et al. | 210/770 |

FOREIGN PATENT DOCUMENTS

32607/68 11/1972 Australia .

OTHER PUBLICATIONS

B. Stanmore, D.N. Baria and L.E. Paulson, "A Steam Drying of Lignite: A Review of Processes and Performance", DOE/GFETC/RI–82–1, (DOE 82007849), 1982.

L.A., Heredy, "Coal Upgrading at Moderate Temperatures,": EPRI Final Report No. AP–4343, Nov. 1985; California.

W.G. Willson, et al., Low–Rank Coal Water Slurries For Gasification, Summary Report, EERI AP–4262, Nov. 1985; North Dakota.

Dr. Yufu Li, Hot–Water Drying of Two Alaskan Low–Rank Coals (Thesis), Dec. 1990, Fairbanks, Alaska.

G.G. Baker, et al. "Hydrothermal Preparation of LRCW Fuel Slurries," Newer Coal Technologies Conf., Honolulu, Hawaii, May 1985.

T.A. Potas, R.E. Sears, D.J. Maas, G.G. Baker, W.G. Willson, "Preparation of Hydrothermally Treated LRC–Water Slurries," Chemical Engineering Communications, vol. 44, pp. 133–151. Date unknown.

T.A. Potas, G.G. Baker, D.J. Maas, and S.A. Farnum, "Pilot Scale Preparation of Lignite and Subbituminous Coal/Water Fuels," Coal/Water Preparation and Utilization Conference, Orlando, FL, May 1986.

*Primary Examiner*—Jacqueline V. Howard
*Assistant Examiner*—Cephia D. Toomer
*Attorney, Agent, or Firm*—Zarley, McKee, Thomte, Voorhees & Sease

[57] ABSTRACT

Methods for enhancing the flow behavior and stability of hydrothermally treated slurry fuels. A mechanical high-shear dispersion and homogenization device is used to shear the slurry fuel. Other improvements include blending the carbonaceous material with a form of coal to reduce or eliminate the flocculation of the slurry, and maintaining the temperature of the hydrothermal treatment between approximately 300° to 350° C.

23 Claims, 1 Drawing Sheet

METHODS TO ENHANCE THE CHARACTERISTICS OF HYDROTHERMALLY PREPARED SLURRY FUELS

CROSS REFERENCE TO RELATED APPLICATION

This application is a continuation of co-pending, commonly owned United States provisional application Ser. No. 60/019,780 filed Jun. 14, 1996, entitled METHOD TO ENHANCE THE CHARACTERISTICS OF HYDROTHERMALLY PREPARED SLURRY FUELS, priority is claimed under 35 U.S.C. § 120.

GRANT REFERENCE

Work on the invention described herein was funded in part by the U.S. Department of Energy, Cooperative Agreement Nos. DE-FC21-83FE60181, DE-FC21-86MC10637, DE-FC21-93MC30097, and DE-FC21-93MC30098. The U.S. Government may have certain rights in the invention.

BACKGROUND OF THE INVENTION

The present invention relates to slurry fuels and, more particularly, methods to enhance the characteristics of hydrothermally prepared slurry fuels.

Of all the coal-based alternative fuels, coal-water fuels (CWFs) appear the most promising. In general, CWF technology was developed to make coal usage more practical and environmentally acceptable, particularly in the "clean" formulation. CWFs were developed as a direct replacement for oil, not as a replacement for dried coal. Even so, CWF has distinct advantages over pulverized coal in many applications; one basic advantage is that CWF is easier to handle, requiring less complicated equipment. This is especially true in pressurized systems such as advanced gasifiers, pressurized fluid-bed combustors, turbines, and diesel engines. Another advantage is that CWFs are nonhazardous, while pulverized coals produce dust and tend to combust spontaneously.

Commercial efforts to produce CWF from high-rank bituminous coals generally involve mixing finely ground coal and water, applying coal-specific cleaning procedures, followed by mechanical dewatering, if necessary, and final fuel formulation, at which time proprietary and most often costly additives are used to further enhance the product fuel. However, the processing steps for producing CWFs from low-rank coals (LRCs) are much different from those used for high-rank coals, since they must accommodate the high inherent moisture content of the LRCs. A hydrothermal treatment process, also known as hot-water drying (HWD), is one way to successfully produce high-grade CWF from LRCs. In the process, nature's coalification process is essentially accelerated. Exposing the coal to elevated temperatures and pressures for a time scale of minutes rather than geological eras produces irreversible changes, such as the evolution of $CO_2$, release of bound cations, and tar sealing of micropores. These changes reduce the equilibrium moisture and hydrophilicity of the coal. Meanwhile, the inherent advantages of the LRCs, including the amount of volatiles and properties and structure of the char, are maintained, preserving their high reactivity and nonagglomerating tendencies. These advantages are very important when CWF is considered as a replacement for oil. However, even with hydrothermal treatment, most LRC slurries are only of marginal quality for energy-related applications. Further enhancements are required to generate the quality of CWF for significant replacement of oil. Potential markets for LRC water slurries include power stations, industrial furnaces, and institutional heating plants, especially those originally designed to burn coal but now modified to use oil. Thus, there is a need in the art for improved methods for preparing high-grade slurry fuel from LRC and other carbonaceous materials.

To consider a system which includes slurry processing or handling, one must be aware of the interaction between the solid and carrier medium. Changes in slurry viscosity and other flow properties, because of variations in solids content and temperature, can drastically alter the energy or equipment needed to further process or handle the slurry. Slurry viscosity and stability depend on the energy of interactions among slurry particles and wetting properties of the solid. Also, the solids particle size, shape, and the concentration impacts properties of the dispersion itself. One characteristic that is common for suspended solids is flocculation, which is governed by the balance between the forces of attraction and repulsion between the particles. The gelling of solids inhibits the flow behavior of the slurry and also detrimentally affects the static stability of the mixture. The stability of a dispersion with respect to flocculation depends on the relative magnitude of the potential energy of attraction and that of repulsion of the particles involved.

In the area of development of CWF, obtaining maximum solids loading and stability of the coal in water has led researchers to produce surface conditioning agents. To use coal as a quasi-liquid fuel, the coal is crushed and pulverized to approximately 70% less than 200-mesh particle size. The coal is then mixed with water to a given viscosity, prior to the addition of the surfactant or dispersant material. The additives adjust the pH of the medium, limit flocculation, or surface coat the coal particle as a means of slurry flow enhancement. These adjustments sufficiently improve the handling characteristics enough to maintain pumpable fluid while increasing the solids loading in the carrier fluid by 2 to 5 wt %. This technology has been widespread for the enhancement of bituminous coal and water mixtures. These additives, when tested with low-rank solid material such as lignite coals, were only minimally effective in lowering the viscosity. The LRC slurries differ from bituminous coal slurries in oxygen/carbon ratio, moisture level, and porosity. Each of these contributed to the poor product performance of LRC slurry fuel technology.

Hydrothermal treatment or pressure cooking the LRC slurry has been demonstrated to be an effective method of lowering the oxygen:carbon ratio and also reducing the inherent moisture content of the coal. However, during the process, hydroaromatic compounds may create increased particle flocculation and inhibit the flow characteristic. Mixing the slurry at low speed (e.g., shear rates less than 10,000 $sec^{-1}$) produces a slurry which is fundamentally unstable, flocculating rapidly to form a volume-filling network throughout the continuous phase. The water is essentially immobilized by the network of chains, and the coal-water mixture behaves as an elastic solid under low stress. The term gel is used to describe such systems. Thus, there is a need in the art for an improved method of preparing slurry fuels from carbonaceous materials that does inhibit the flow characteristics of the slurry.

While there are a number of problems that are encountered when attempting to utilize biomass, agriculture wastes, or other solid wastes for energy production, the heterogeneity of the material is the source of many of the problems. One characteristic of hydrothermal treatment is to homogenize the material into a more chemically and physically consistent slurry fuel. The pumpable slurry has the advantages of being easily transported and injected into utilization systems. Since its moisture content is controlled to a constant level, the need for constant process and excess air adjustments when utilizing the fuel for power generation is avoided. The homogeneity of the fuel also promotes more consistent emissions during combustion, an important factor in the much regulated waste-to-energy industry. Although hydrothermal treatment helps to produce a homogeneous slurry fuel, it has only a limited effect. As such, there is still a need in the art for even more effective methods of homogenizing biomass and other solid waste for producing high-quality, homogeneous slurry fuels for energy applications.

It can therefore be seen that there is a real and continuing need for the development of improved methods for preparing high-grade slurry fuels from LRC and other carbonaceous materials.

The primary objective of the present invention is the provision of improved methods for preparing high-grade slurry fuels that are efficient in operation.

Another objective of the present invention is the provision of improved methods for preparing hydrothermally treated slurry fuels suitable for use in energy-related applications as replacements for oil.

Another objective of the present invention is the provision of improved methods for preparing hydrothermally treated slurry fuels from carbonaceous materials that do not inhibit the flow characteristics of the slurry.

Still another objective of the present invention is the provision of more effective methods of homogenizing biomass and other non-coal carbonaceous materials for producing high grade, homogeneous slurry fuels for energy-related applications.

These and other features, objects, and advantages will become apparent to those skilled in the art with reference to the accompanying specification.

SUMMARY OF THE INVENTION

The foregoing objectives are achieved in a preferred embodiment of the invention by a method for preparing a slurry fuel from a carbonaceous material subjected to a hydrothermal treatment comprising the steps of providing a mechanical high-shear dispersion and homogenization device, and performing at least one of the following steps: shearing the slurry in the mechanical high-shear device; blending the carbonaceous material and a form of coal; and maintaining the temperature of the hydrothermal treatment between approximately 300° to 350° C.

The first aspect of the invention relates to the introduction of mechanical high-shear dispersing and homogenization equipment to control the viscosity and stability of the slurry fuel. The slurry may be sheared in either a batch or continuous mode at several different times through the process. In the continuous mode, use of a commercially available in-line shearing device is preferred.

Another aspect of the invention relates to the addition of coal in the hydrothermal treatment of biomass and other non-coal carbonaceous materials. During the development of such fuel blends, a synergistic effect has been noted with substantial improvements in the loadings and stability of the slurry.

A still further aspect of the present invention concerns the identification of optimum temperature processing conditions to optimize the hydrothermal treatment of the slurry and maximize the desirable slurry characteristics. Specifically, it has been found that performing the slurry hydrothermal treatment at a temperature within the range of 300° to 350° C. produces slurries with the highest solids loading and the best Theological properties. Further, passing the slurry through a hydroclone before pressure letdown to ambient conditions takes advantage of the stored energy from the hydrothermal process to at least partially dewater and concentrate the slurry, obviating the need to depressurize and use commercial filtration equipment.

DETAILED DESCRIPTION OF THE PREFERRED EMBODIMENT

Figure 1:
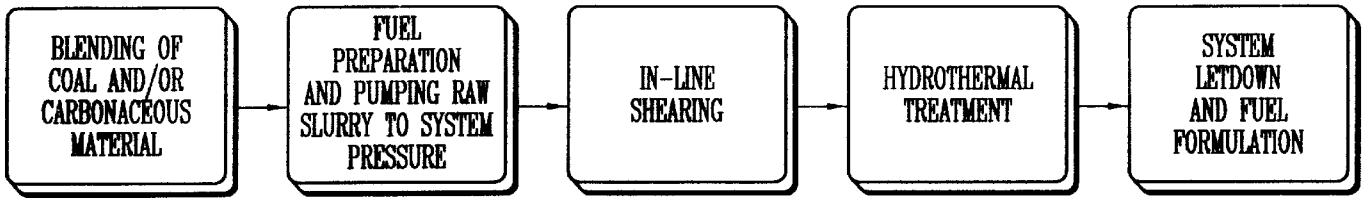
FIG. 1 is a flow chart showing a preferred method for preparing hydrothermally treated carbonaceous slurry fuels.

One of the principal techniques used to evaluate the quality of CWFs is rheological or slurry flow behavior. Rheology is the study of the properties and behavior of matter in the fluid state. Initial Theological testing was completed by hand-mixing hydrothermally treated material with water. Results showed that the slurries were characterized as pseudoplastic and thixotropic, indicating a force and time dependence relative to shear rate. A pseudoplastic slurry is one whose viscosity decreases as shear rate or force is increased, meaning it becomes more easy to pump or atomize. This characteristic is especially critical to slurry gasification or combustion systems which require atomization as a means of feeding. At the tip of a conventional spray nozzle, shear rates as high as 100,000 $sec^{-1}$ can be achieved. Pseudoplastic or "shear thinning" CWF ensures effective spray patterns, resulting in reduced droplet size and enhanced carbon efficiencies.

A CWF characterized as thixotropic is one whose viscosity is dependent on the application of shear rate over time. For example, as CWF is being pumped through a pipe which applies constant shearing forces to the medium, the viscosity of the CWF is reduced. This is also an excellent property for CWF and pipeline transportation options.

Pseudoplastic flow characteristics make hydrothermally treated coal slurries an excellent candidate for high-shear dispersing as a means of lowering the viscosity. High-shear dispersing and homogenizing is currently commercially available, with equipment ranging in power from 0.1 to 150 hp. Units are available for continuous processing at rates exceeding 1000 gal/min. In-line units incorporate specially designed high shear rotor/stator processing workheads. The material to be processed is first pumped to the shear unit and then passes through a hydraulic and mechanical shearing process, exposing it to shear rates exceeding 70,000 $sec^{-1}$ at the rotor tips. In the in-line homogenizer, the workhead is set into a wall which divides the machine into two separate chambers, one with the inlet tube attached and the other with the outlet. Because of this construction, it is physically impossible for any materials to pass from the inlet to the outlet without being subjected to the shearing actions. In-line high-shear dispersion and homogenization units suitable for use with the invention include IKA WORKS Inc.'s Dispax-Reactor and Silverson Machines Inc.'s In-line Homogenizer. Similar units are already being used in making emulsions, dye suspensions, paints, paper coatings, and numerous other applications in the food and pharmaceuticals industry. It was not initially apparent, however, that these high-shear units would be suitable for use with LRC-water slurries because of the much larger particle size and hardness of the coal. Not surprisingly, there has to date been no commercial use of these in-line shearing devices for CWF preparation.

The primary improvement to LRC water fuel development in the present invention for dispersing and homogenization is the introduction of technology, i.e., mechanical high-shear dispersing and homogenization, to control the viscosity and stability of the fuel prior to hydrothermal treatment or atomization. Low-rank solids include lignite, subbituminous coal, peat, wood or sawdust, and sewage sludge. During the shearing process the prescribed mixture of coal and water is subjected to intense hydraulic shear by the high speed rotation of the rotor inside the confined space of the stator chamber. Centrifugal force then drives the slurry towards the workhead where it is subjected to a milling action in the precision-machined clearance between the ends of the rotor blades and the inner wall of the stator, and finally, intense hydraulic shear action as the slurry is forced, at high velocity, through the perforations in the stator. Such high-shear systems are characterized by shear rates ranging from approximately 10,000 to 100,000 $sec^{-1}$. These systems represent an innovative method of wetting the coal surface, broadening the particle size distribution, and improving the shape of the coal particles for more efficient particle packing. Typical improvements range from 2 to 5% increase in solids content at a given viscosity.

Figure 2:
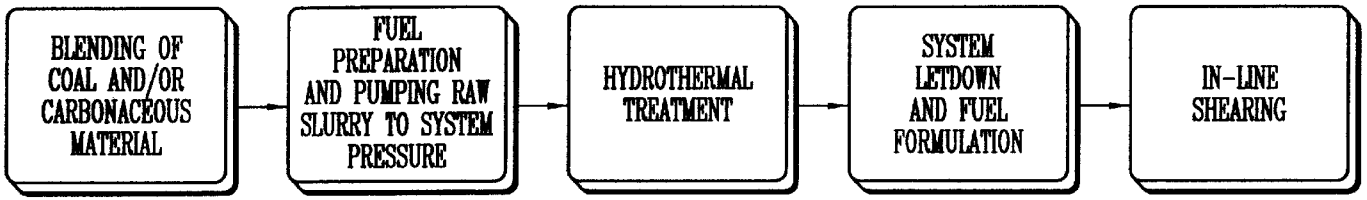
FIG. 2 is a flow chart showing an alternative method for preparing hydrothermally treated carbonaceous slurry fuels.
Figure 3:
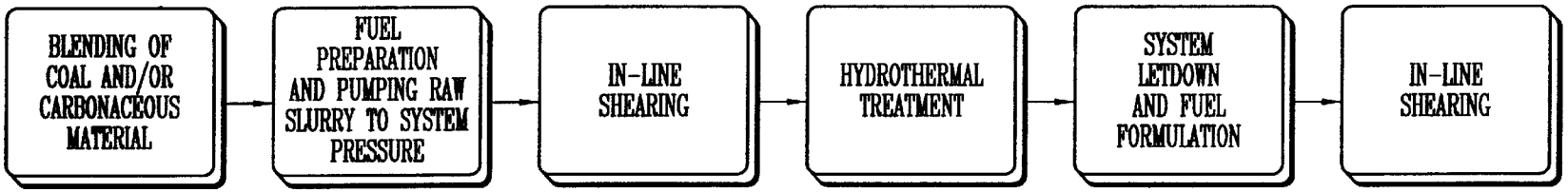
FIG. 3 is a flow chart showing another alternative method for preparing hydrothermally treated carbonaceous slurry fuels.

Specific to hydrothermal treatment, this technology offers an effective way to deflocculate the coal particles. The product has lower viscosity and yield stress and improved particle suspension properties. Processing the material after hydrothermal treatment has the advantage of reduced Hardgrove index or reduced energy to accomplish the shearing. Similar increases in solids loading and slurry stability are realized. Enhancement is also realized by shearing after hydrothermal treatment if the material had been sheared prior to hydrothermal treatment. FIGS. 1–3 show the application of in-line shearing relative to the hydrothermal treatment process. Note that although use of an in-line shearing device is preferred, the slurry may alternatively be sheared in a batch mode using standard mixing equipment.

Prior to the hydrothermal treatment, the slurry is pressurized to maintain a liquid state. The shearing operation can take place either before or after the slurry is pressurized prior to the hydrothermal treatment. As shown in FIG. 2, the slurry may also be sheared after the system letdown (i.e., decrease in pressure) following the hydrothermal treatment.

During the hydrothermal treatment, the slurry is also subjected to a heat exchange to cool the slurry. It has also been found that shearing the slurry after the heat exchange is effective.

A second major improvement of the present invention relates to the addition of coal in the hydrothermal treatment of biomass and other non-coal carbonaceous materials. The inventors have done extensive development of the hydrothermal treatment process. Over 30 different materials have been hydrothermally treated. The inventors noted difficulties in obtaining high solids loadings and good rheological properties when hydrothermally treating non-coal-based materials such as wood, wood wastes, agriculture wastes, sewage and other industrial sludges, and MSW, and other carbonaceous materials. It was also recognized that there were benefits of mixing these low-sulfur fuels with coal to produce a fuel compliant in sulfur. During the development of these fuel blends, a synergistic effect was noted, and substantial improvements in the loadings and stability of the slurry were noted. When thermally treated by themselves, feedstocks containing plastics have a tendency to agglomerate which will plug process lines and/or equipment. The coal serves as a buffer or diluent to reduce the chances of mechanical failure during mechanical high shear dispersion and hydrothermal processing. Therefore, the invention includes the blending of coal (e.g., bituminous, subbituminous, lignite, or brown) with other non-coal carbonaceous materials (e.g., wood, wood wastes, agriculture by-products, plantation crops, municipal and industrial solid and liquid wastes, and other biomass materials) as a method of improving the products of hydrothermal treatment. In this embodiment, the coal and other carbonaceous material are preferably mixed and subjected to hydrothermal treatment as a blend. High speed dispersion/homogenization is especially applicable to these fuels, as it successfully breaks down the cellulose structures that hinder its ability to form high density, low viscosity, stable slurries.

Thirdly, significant improvements have been raised through the identification of more ideal processing conditions. Through their extensive testing, the inventors have been able to optimize the hydrothermal treatment process to maximize the desirable slurry characteristics. These optimization efforts have determined that performing the hydrothermal treatment at a temperature within the range of 300° to 350° C. produce slurries with the highest solids loading and the best rheological properties while allowing recovery of most of the energy density from the original fuel as a slurry rather than a gas.

To directly couple the hydrothermal treatment with advanced gasification units, the slurry needs to be partially dewatered at pressure. Manifold hydro cyclones (also referred to as hydroclones or cyclones) provide an efficient means to partially dewater coal slurries at operating pressures between 500 to 1500 psig. Differential pressure is critical for proper operation. The higher the differential pressure, the more efficient the separation action. The differential pressure is the drop from the feed pressure to that of the overflow. Cyclone design plays a big part in developing high separation efficiency. The shape of the cyclone, the angle of its cone, and the underflow opening size are all important. Hydrothermal applications work well since there is an abundance of system pressure available prior to injection into the gasifier. By controlling the pressure drop across the cyclone and the cyclone design, the user may effectively control the discharged solids loading and fuel viscosity levels.

For applications where hydrothermal treatment is directly coupled with a utilization system, the pressurized slurry coming directly from the hydrothermal reactors would be fed tangential to the cyclone cone. The liquid phase rotates at a high velocity, very much like a whirlpool. The coal particles are thrown to the wall of the cyclone and pass downward and out the underflow discharge. Cleaned liquid spins into the center of the cyclone and is forced upward and out the overflow discharge. These systems can handle slurries containing coarse solids which segregate in the distribution system by radial manifolding to assure uniform feed and pressure distribution. For slurries that do not segregate, equal feed distribution for all cyclones can be accomplished by mounting the cyclones in-line. In an in-line system, the distributing and receiver pipes are designed with gradually reduced diameters so that the feed can be accepted and distributed at approximately even flow velocity, thereby accomplishing the dewatering. In particular, the TMC DOXIE hydroclones designed by Dorr Oliver have been used in the past for coal liquefaction applications. It was not initially apparent, however, that these hydroclones would be suitable for use with hydrothermal systems because of much higher pressure conditions, larger coal particle size, and higher solid concentration. In this embodiment, the dilute coal water slurry from the hydrothermal treatment would be dewatered at pressure and temperature. The dewatered slurry would be fed directly to the combustion or gasification system without sensible heat or depressurizing losses that accompany current designs.

EXAMPLES OF THE INVENTION

Various experiments were conducted to illustrate the invention previously described. This work is applicable to LRC (e.g., brown coal, lignite, and subbituminous coal) and biomass and any blend. It should be mentioned that the following serve only as examples and should not limit the application of the aforementioned technology. Pulverized coal (80% less than 200 mesh) was hand-mixed with water to produce a pumpable slurry with a viscosity between 100 to 5000 cP. Slurries were then processed to determine the effect of shear on rheology and fuel stability. Experiments were initially completed using batch and in-line systems capable of shearing at shear rates exceeding 30,000 $sec^{-1}$. The samples were then analyzed based on particle-size distribution and flow behavior. Rheological properties were investigated using a concentric cylinder Haake RV100 viscometer. Shear stress versus shear rate rheograms were recorded over the shear rate range of 0 to 440 $sec^{-1}$. The reported viscosity data are at a shear rate of 100 $sec^{-1}$. The particle-size distribution of the unsheared and sheared samples was determined using a Malvern 2600c laser diffraction particle-size analyzer capable of measuring particle sizes from 0.5 to 564 microns. Particle-size results are reported as the particle size in microns where less than 10%, 50%, and 90% of the cumulative size occurs.

EXAMPLE 1

Example 1 uses Coal A, a subbituminous coal, which has been hydrothermally treated. The sample was first pulverized to standard combustion grind and mixed with water at a 50:50 ratio. The feed slurry was then treated using a hydrothermal treatment plant facility. The product slurry was dewatered using a recess filter press assembly. Filter cake was stored for future consideration and Theological testing. A portion of the filter cake was remixed with water, producing pumpable CWF. The CWF was sheared in a batch mode using a laboratory blender to determine the effect of shear and time dependence.

In this example, tests were completed to illustrate the force- and time-dependent nature of the CWF. Tests were conducted at different speeds to demonstrate the results of a change of shear rate. Samples were also sheared for two different time periods. Table 1 illustrates the results from the test program. The results further illustrate the shear thinning nature of the product, with the lowest viscosity being determined at the highest speed for the longest period of time.

TABLE 1

The Effect of Shear Force and Time on the Viscosity of a Hydrothermally Treated Coal A

| Time, minutes | Mixing blade speed, rpm | Particle Size, microns $d_{10}$ | $d_{50}$ | $d_{90}$ | Viscosity[1], cP |
|---|---|---|---|---|---|
| | Control Sample Unsheared | | | | 354 |
| 5 | 10,000 | 8.2 | 53.6 | 172 | 258 |
| | 20,000 | 7.5 | 50 | 148 | 174 |
| | 30,000 | 6.6 | 36.4 | 101 | 153 |
| 15 | 10,000 | 7.4 | 45 | 129 | 191 |
| | 20,000 | 6.5 | 37.8 | 115 | 154 |
| | 30,000 | 6.7 | 38.5 | 105 | 118 |

[1]Viscosity of slurry with 54% dry solids and a shear rate of $100^{sec-1}$.

EXAMPLE 2

Similar to Example 1, coal samples were batch sheared to determine the effect of shearing the raw fuel vs. the hot-water dried product and the applicability of shearing to various fuels. For this example, coal was pulverized to combustion grind and mixed with water to a pumpable viscosity. The slurry was then sheared in the laboratory mixer system for 5 minutes with a selected volume of slurry. Particle size and rheology analysis were then conducted on various samples. Four different coals representing both subbituminous (Coal B and C) and lignitic (Coal D) coals, and shredded biomass were evaluated. These are noted as raw since they were sheared prior to hydrothermal treatment. Also, samples of the four coals and wood were pulverized and mixed with water then hydrothermally treated and processed using the laboratory mixer similar to the raw coal. Table 2 summarizes the particle size and viscosity information for the four fuels. The reported solids content is determined prior to analysis. The results illustrate the positive impact of shearing the coal prior to and after hydrothermal processing. Particle-size distribution was reduced with the creation of more colloidal size material, which produces efficiently packed solids-liquid mixtures. Viscosity was reduced twofold by shearing the raw coal and similar results were obtained from shearing the hydrothermal slurries. Small particle size, unfortunately, causes an increase in friction and forces production of a more viscous slurry. These results indicate that it is not obvious that an improvement in rheological properties will result by simple shearing and that an understanding of the nature of the material is required to determine the applicability of this process.

TABLE 2

The Effect of Shearing on Various Coals and Wood Before and After Hydrothermal Treatment

| | Solids[1] Loading, wt% | Particle Size, microns $d_{10}$ | $d_{50}$ | $d_{90}$ | Viscosity[2], cP |
|---|---|---|---|---|---|
| Coal B | | | | | |
| Raw | 49 | 11.5 | 67 | 199 | 650 |
| Raw Sheared | 49 | 5.7 | 43 | 144 | 150 |
| HWD Unsheared | 54 | NA[3] | NA | NA | 380 |
| HWD Sheared | 54 | 7.5 | 50 | 148 | 190 |

TABLE 2-continued

The Effect of Shearing on Various Coals and Wood Before and After Hydrothermal Treatment

| | Solids[1] Loading, wt% | Particle Size, microns $d_{10}$ | $d_{50}$ | $d_{90}$ | Viscosity[2], cP |
|---|---|---|---|---|---|
| Coal C | | | | | |
| Raw Unsheared | 39.7 | 20 | 134 | 360 | 193 |
| Raw Sheared | 39.9 | 6.9 | 97 | 335 | 43 |
| HWD Unsheared | 55.2 | 11.4 | 75 | 247 | 1479 |
| HWD Sheared | 56.2 | 6.1 | 74 | 244 | 171 |
| Coal D | | | | | |
| Raw Unsheared | 33.1 | 23 | 75 | 222 | 1029 |
| Raw Sheared | 32.9 | 5.7 | 43 | 178 | 417 |
| HWD Unsheared | 44.5 | 5.8 | 38 | 148 | 1742 |
| HWD Sheared | 44.4 | 5.8 | 38 | 148 | 317 |
| Biomass | | | | | |
| HWD Unsheared | 51.5 | 5.4 | 24 | 105.8 | 710 |
| HWD Sheared | 51.5 | 4.1 | 17 | 74.7 | 185 |

[1]Pct bone dry solids in slurry.
[2]Viscosity at $100^{sec-1}$.
[3]Information not available.

EXAMPLE 3

The applicability of shearing to pumpability of the slurries is illustrated by this example, which shows the effect shearing has on pressure drop for a given slurry pipeline transportation system. Using available rheological information, the pressure drop for the non-Newtonian mixture was determined for transporting 1.5 million tons of CWF using a 16-inch pipe. The estimated mixer speed was 20,000 rpm. Similar to Example 1, Coal A was pulverized and then sheared for various lengths of time. Samples were then analyzed to determine particle size and rheological behavior. Information was then processed by a computer modeling program to determine the pressure drop for a given pipe diameter and terrain. Table 3 summarizes the results. Pressure drop was dramatically reduced as shear was applied, reducing pumps horsepower required.

TABLE 3

Impact of Shear Time on the Estimated Pressure Drop for Slurry Pipeline Transport

| Shearing Time, Seconds | Particle, Size microns $d_{10}$ | $d_{50}$ | $d_{90}$ | Viscosity[1], cP | Estimated Pressure Drop, psi |
|---|---|---|---|---|---|
| 0 | 5.2 | 36 | 113 | 578 | 4.25 |
| 60 | 4.9 | 32 | 104 | 506 | 2.34 |
| 120 | 4.6 | 29 | 108 | 409 | 1.45 |
| 180 | 4.2 | 25 | 83 | 399 | 1.28 |
| 240 | 4.1 | 24 | 80 | 368 | 1.08 |
| 300 | 3.9 | 22 | 79 | 383 | 1.17 |

[1]Calculated for a solids loading of 54% at a shear rate of $100^{sec-1}$.

EXAMPLE 4

The sheared samples were produced using a laboratory mixing assembly. The results illustrate a significant improvement in the static stability of sheared samples compared to the unsheared samples. Similar to the reduction in viscosity, the enhanced stability is likely due to the improved particle packing of solids and improved solid-liquid interface. Table 4 summarizes the results for the various samples. The static stability was investigated by preparing slurry fuels at 500 cP and 700 cP in a quart jar with a rod penetrometer procedure used to measure stability. Results are reported in terms of hours until approximately 10% and 50% of the solids had settled.

TABLE 4

The Impact of Shearing on the Stability of the Slurry

| | Particle Size, microns $d_{10}$ | $d_{50}$ | $d_{90}$ | Solids[1] Loading | Viscosity[3] cP | Prepared Fuel Stability[1] $S_{10}$ | $S_{50}$ |
|---|---|---|---|---|---|---|---|
| Coal A | 38.2 | 144 | 288 | 42.5 | 515 | 1 | 7 |
| Coal A (Sheared) | 20.9 | 108 | 288 | 45.2 | 502 | 8 | 28 |
| Coal B | 8.7 | 49 | 145 | 49.0 | 700 | 5 | 48 |
| Coal B (Sheared) | 5.3 | 38 | 122 | 50.2 | 700 | 48 | 220 |
| Coal A HWD | 4.6 | 30 | 88 | 50.4 | 530 | 5 | 12 |
| Coal A HWD (Sheared) | 4.3 | 29 | 87 | 52.1 | 550 | 60 | 168 |

[1]$S_{10}$ and $S_{50}$ are the time required for 10% and 50% of the solids to settle, respectively.
[2]PCT bone-dry solids.
[3]Viscosity at a shear force of $100^{sec-1}$.

EXAMPLE 5

This example illustrates the effectiveness of in-line as compared to batch (laboratory blending) shearing. As mentioned previously, the in-line homogenization offers a continuous method to apply high shear action to slurries. Specific to the hydrothermal process, shear testing was conducted both prior to and after the hydrothermal treatment process for three different coals. Table 5A summarizes the comparative analysis. Coals A, B, and C are subbituminous coals.

In addition, tests were also completed in various processing schemes using the in-line shear units. Tests included pumping the mixture both once and twice through the shear unit's intense mixing actions. Slurries were also circulated through shear units for approximately 10 minutes. Results including viscosity information are recorded in Table 5B for various types of coals. Lower viscosities were recorded, illustrating the potential of aligning the shear units in series. Circulated samples yielded slightly lower viscosities compared to uncirculated samples.

5A - Bench Vs. In-Line Shearing

| Sample Identification | Solids Loading wt% | Unsheared Viscosity, cP | Batch Sheared Viscosity, cP | In-Line Sheared Viscosity, cP |
|---|---|---|---|---|
| Coal A HWD | 51.9 | 940 | 540 | 218 |
| Coal B | 49.5 | 650 | 510 | 488 |
| Coal B HWD | 57.0 | 844 | 575 | 567 |
| Coal E HWD | 57.2 | 730 | 565 | 590 |

5B - Viscosity Information for In-Line Shearing

| Sample Identification | Solids Loading, wt% | Feed Slurry Viscosity cP | 1 Time Thru Viscosity cP | 2 Time Thru Viscosity cP | Circulated Viscosity cP |
|---|---|---|---|---|---|
| Coal B | 46.2 | 588 | 219 | 211 | ND |
| Coal B HWD | 55.5 | 760 | 589 | 513 | ND |
| Coal B HWD | 57.8 | 913 | 471 | 450 | 393 |

EXAMPLE 6

Low rank fuels contain appreciable carboxylic acids, which contribute to their low heating value and their affinity toward moisture absorption. Through hydrothermal treatment, at conditions between 300° to 350° C., a large portion of the moisture is expelled, and surface changes occur which greatly effect the solid's affinity for absorbing moisture. The result is lower moisture content, greater heating value, and improve slurriability. Tests were conducted at various temperatures to emphasize the importance the conditions of hydrothermal treatment play when considering a slurry/liquid fuel. Table 6 expresses the solids loading information for a particular coal and the temperature effects. Specifically for this example, Coal F, a brown coal was slurried in water and hydrothermally treated at three temperatures ranging from 250° to 325° C. The solids were then recovered, filtered, and reslurried with water. Shearing was performed using the laboratory mixing assembly. The improved slurry solids loadings and heating values were the results of physical and chemical changes in the coal due to hydrothermal processing. This example also illustrates the effects hydrothermal treatment and shearing have on the attainable solids content of a particular fuel. The 250° C. results were the most impressive for illustrating the effects of shearing the slurry fuels. The slurry fuel solids content was improved by over 5 wt % by increasing the temperature to between 300° and 350° C.

TABLE 6

Effects of Shearing and Temperature

| | Before Shearing | | After Shearing | |
|---|---|---|---|---|
| Sample Identification | Solids Loading, wt% | Viscosity, cP | Solid, loading, wt% | Viscoity, cP |
| Coal F Raw | 27.3 | 866 | 27.3 | +2000 |
| Coal F HWD 250° C. | 36.4 | 3280 | 36.3 | 132 |
| Coal F HWD 275° C. | 37.8 | 941 | 37.7 | 150 |
| Coal F HWD 325° C. | 41.6 | 865 | 40.4 | 271 |

EXAMPLE 7

Tests were performed with various blends of coal and solid waste as a means to control viscosity and enhance fuel stability. Samples were prepared with Coal G, a North Dakota lignite, potato waste, and wood wastes. The raw slurries were not analyzed for slurry fuel characteristics since the fibrous materials tended to separate readily from water, making it difficult to record both an accurate viscosity and particle size. Table 7 illustrates the results. Wood waste and agriculture material yield poor solids contents, ranging from 5 to 15 wt %, depending on particle size and shape and solids characteristics. After hydrothermal treatment, the slurries were enhanced to 30 to 40 wt %. By blending 50:50 with coal, the solid contents were further enriched to over 50 wt %. Also, Table 7 outlines the static stability information for various fuels. For stability testing, the solids were adjusted until the slurry viscosity was near 500 cP. The static stability of a quart-size sample was determined by the glass rod penetrometer test. Analysis was performed at the distance of penetration the glass has in the test sample. Results illustrate the elapsed time where 10% and 50% of the solids had settled.

TABLE 7

Combined Effects of Blending and Shearing for Improving Solids Loading and Viscosity of Hydrothermally Treated Material

| | Shearing Effects | | | Stability Information | | |
|---|---|---|---|---|---|---|
| Sample Identification | Solids Loading, wt % | d50 | Viscosity, cP | Solids Loading, wt % | S10 | S50 |
| Wood HWD | 28.4 | | 200 | 30.2 | 0.5 | 4 |
| Wood HWD Sheared | 33.5 | | 250 | 34.5 | 26 | 76 |
| Wood-Coal G HWD | 50.6 | | 500 | 50.6 | 3 | 25 |
| Wood-Coal G HWD Sheared | 50.9 | | 154 | 54.4 | 8 | 40 |
| Potato Waste-Coal G HWD | 52.3 | | 695 | 50.8 | 7 | 28 |
| Potato Waste-Coal G HWD Sheared | 52.0 | | 278 | 53.1 | 28 | 78 |
| Coal G HWD | 51.5 | | 340 | 52.6 | 3 | 25 |
| Coal G HWD Sheared | 51.6 | 26.4 | 153 | 55.1 | 28 | 68 |

EXAMPLE 8

A two-gallon autoclave assembly was used to demonstrate the concentration of hydrothermally prepared slurries without pressure reduction. The autoclave was loaded with a mixture of 45 wt % pulverized coal and water. The slurry was heated to 500° F. and 600 psi pressure. Once at conditions, the bottom slurry valve was opened, transferring the slurry to a Doxie Type A 10-mm cyclone system designed and manufactured by Dorr Oliver. Valves positioned at the overflow and underflow process streams from the hydroclone allowed the operator to maintain constant flow and outlet pressures between 25 and 75 psig. The results indicated that hydroclone concentrated the slurry to near 50 wt %. Solids concentration in the overflow was only 2.8 wt %.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A method of preparing a slurry fuel from a carbonaceous material subjected to a hydrothermal treatment, said method comprising:

preparing a slurry comprising said carbonaceous material and water;

subjecting said slurry to said hydrothermal treatment; and passing said slurry through a mechanical high-shear dispersion and homogenization device operating at a shear rate of between about 10,000 to about 100,000 reciprocal seconds to shear said slurry to provide a slurry with improved viscosity and stability relative to a slurry sheared at rates of 0 to less than about 10,000 reciprocal seconds.

2. The method of claim 1 wherein said slurry is sheared in said mechanical high-shear dispersion and homogenization device after said hydrothermal treatment.

3. The method of claim 1 wherein said slurry is sheared in said mechanical high-shear dispersion and homogenization device in a batch mode.

4. The method of claim 1 wherein said slurry is sheared in said mechanical high-shear dispersion and homogenization device in a continuous mode.

5. The method of claim 4 wherein said mechanical high-shear dispersion and homogenization device is an in-line shearing device.

6. The method of claim 1 wherein said slurry is pressurized to maintain a liquid state prior to said hydrothermal treatment, and said slurry is sheared before being pressurized.

7. The method of claim 1 wherein said slurry is pressurized to maintain a liquid state prior to said hydrothermal treatment, and said slurry is sheared after being pressurized and before said hydrothermal treatment.

8. The method of claim 1 wherein said slurry is subjected to a heat exchange to cool the slurry during said hydrothermal treatment, and said slurry is sheared after said heat exchange.

9. The method of claim 1 wherein said slurry is subjected to a decrease in pressure after said hydrothermal treatment, and said slurry is sheared after said decrease in pressure.

10. The method of claim 1 further comprising the step of maintaining the temperature of said hydrothermal treatment between approximately 300° to 350° C.

11. The method of claim 1 wherein said slurry is subjected to a decrease in pressure to ambient conditions after said hydrothermal treatment, said method further comprising the step of passing said slurry through a hydro-cyclone before said decrease in pressure to at least partially dewater and concentrate said slurry.

12. A method of preparing a slurry fuel from a non-coal carbonaceous material subjected to hydrothermal treatment, said method comprising:

blending said carbonaceous material, a form of coal, and water to make a slurry; and passing said slurry through a mechanical high-shear dispersion and homogenization device operating at a shear rate between about 10,000 to about 100,000 reciprocal seconds to provide a nonagglomerating fuel.

13. The method of claim 12 wherein said form of coal includes at least one of the following: (a) bituminous coal; (b) subbituminous coal; (c) lignitic coal, or (d) brown coal.

14. The method of claim 12 wherein said non-coal carbonaceous material includes at least one of the following: (a) wood; (b) wood pulp; (c) agricultural by-products; (d) solid waste; or (e) liquid waste.

15. The method of claim 12 further comprising the step of maintaining the temperature of said hydrothermal treatment between approximately 300° to 350° C.

16. A method of preparing a slurry fuel from a carbonaceous material subjected to a hydrothermal treatment, said method comprising:

preparing a slurry comprising carbonaceous material and water; pressurizing the slurry to maintain a liquid state;

shearing the slurry at a rate between about 10,000 to about 100,000 reciprocal seconds; and subjecting the slurry to said hydrothermal treatment at a temperature wherein the temperature of said hydrothermal treatment is maintained between about 300° and about 350° C.

17. The method of claim 16 further comprising the step of passing said slurry through a mechanical high-shear dispersion and homogenization device after the hydrothermal treatment to shear said slurry to provide a slurry with improved viscosity and stability.

18. The method of claim 16 further comprising the step of blending said carbonaceous material and a form of coal to provide a nonagglomerating slurry fuel.

19. The method of claim 17 further comprising the step of blending said carbonaceous material and a form of coal to provide a nonagglomerating slurry fuel.

20. A method of preparing a slurry fuel subjected to a hydrothermal treatment, where the slurry fuel is prepared from a carbonaceous material, said method comprising:

preparing a slurry from said carbonaceous material and water;

passing said slurry through a mechanical high-shear dispersion and homogenization device operating at a shear rate between about 10,000 to about 100,000 reciprocal seconds to shear said slurry to provide a slurry with improved viscosity and stability relative to a slurry sheared at rates of 0 to less than about 10,000 reciprocal seconds; and performing at least one of the following steps:

blending said carbonaceous material and a form of coal to provide a nonagglomerating slurry fuel; and subjecting the slurry to hydrothermal treatment at a temperature wherein the temperature of said hydrothermal treatment is maintained between approximately about 300° and about 350° C.

21. A method of preparing a slurry fuel subjected to a hydrothermal treatment, said method comprising:

preparing a coal-water slurry;

subjecting said slurry to said hydrothermal treatment;

passing said slurry through a mechanical high-shear dispersion and homogenization device operating at a shear rate between about 10,000 to about 100,000 reciprocal seconds to provide a slurry with improved viscosity and stability relative to a slurry sheared at rates of 0 to less than about 10,000 reciprocal seconds; and pressurizing said slurry to maintain a liquid state prior to said hydrothermal treatment.

22. A method of preparing a slurry fuel subjected to a hydrothermal treatment, said method comprising:

preparing a coal-water slurry;

subjecting said slurry to said hydrothermal treatment;

pressurizing said slurry to maintain a liquid state prior to said hydrothermal treatment; and passing said slurry through a mechanical high-shear dispersion and homogenization device, where said mechanical high-shear dispersion and homogenization device is operating at a shear rate between about 10,000 and about 100,000 reciprocal seconds to provide a slurry with improved viscosity and stability relative to a slurry sheared at rates of 0 to less than about 10,000 reciprocal seconds.

23. The method of claim 1 wherein said slurry is sheared in said mechanical high-shear dispersion and homogenization device prior to said hydrothermal treatment.

* * * * *

UNITED STATES PATENT AND TRADEMARK OFFICE

CERTIFICATE OF CORRECTION

PATENT NO : 6,053,954

DATED : Apr. 25, 2000

INVENTOR(S) : Anderson et al.

It is certified that error appears in the above-identified patent and that said Letters Patent is hereby corrected as shown below:

In column 4, line 6, delete [Theological] and insert --rheological--.

In column 4, line 28, delete [Theological] and insert --rheological--.

In column 7, line 53, delete [Theological] and insert --rheological--.

In column 8, line 9, delete [354] in Table 1 under the column entitled Viscocity[1].cP.

UNITED STATES PATENT AND TRADEMARK OFFICE

CERTIFICATE OF CORRECTION

PATENT NO. : 6,053,954

DATED : Apr. 25, 2000

INVENTOR(S) : Anderson et al.

It is certified that error appears in the above-identified patent and that said Letters Patent is hereby corrected as shown below:

In column 8, line 10, insert --354-- in Table 1 under the column entitled Viscocity[1].cP.

Signed and Sealed this

Twelfth Day of December, 2000

*Attest:*

Q. TODD DICKINSON

*Attesting Officer*

*Director of Patents and Trademarks*